United States Patent [19]

Nakamura et al.

[11] 4,436,068

[45] Mar. 13, 1984

[54] IGNITION SYSTEM OF AN INTERNAL COMBUSTION ENGINE

[75] Inventors: Norihiko Nakamura, Mishima; Yoshiaki Shibata, Susono, both of Japan

[73] Assignee: Toyota Jidosha Kabushiki Kaisha, Toyota, Japan

[21] Appl. No.: 405,564

[22] Filed: Aug. 5, 1982

[30] Foreign Application Priority Data

Oct. 22, 1981 [JP] Japan ..... 56-167919

[51] Int. Cl.[3] ..... F02P 1/00

[52] U.S. Cl. ..... 123/310; 123/169 MG

[58] Field of Search ..... 123/169 MG, 310

[56] References Cited

U.S. PATENT DOCUMENTS 1,476,252 12/1923 Hempel ..... 123/310

2,904,610 9/1959 Morrison ..... 123/169 MG

FOREIGN PATENT DOCUMENTS 49-42322 4/1974 Japan ..... 123/310

*Primary Examiner*—Ronald B. Cox

*Attorney, Agent, or Firm*—Kenyon & Kenyon

[57] ABSTRACT

An ignition system of an internal combustion engine comprising a metallic plate inserted between the cylinder block and the cylinder head. The metallic plate has an opening, upon the inner peripheral wall of which is mounted a plurality of T-shaped electrodes. Each of the T-shaped electrodes comprises an electrode piece and a conductive bar member connected to the electrode piece. The conductive bar member is surrounded by a tubular insulating member. The tubular insulating member is inserted into bores formed in the metallic plate for forming a condensor between the conductive bar member and the metallic plate. The electrode pieces are arranged in series for forming spark gaps between adjacent electrode pieces, and a high voltage is applied across the electrode pieces.

13 Claims, 7 Drawing Figures

IGNITION SYSTEM OF AN INTERNAL COMBUSTION ENGINE

BACKGROUND OF THE INVENTION

The present invention relates to an ignition system of an internal combustion engine.

In gasoline engines, it is possible to improve the specific fuel consumption and reduce the amount of harmful $NO_x$ and CO components in the exhaust gas by increasing the air-fuel ratio of the fuel mixture fed into the cylinders of the engine, that is, by using a lean air-fuel mixture. Therefore, at present, the use of such a lean air-fuel mixture to cause combustion is considered one of the most preferable combustion methods. However, a lean air-fuel mixture is inherently less easy to ignite. Even if the lean air-fuel mixture is ignited, since the propagating speed of flame of the lean air-fuel mixture is low, the burning velocity of the lean air-fuel mixture is low. Therefore, when such a lean air-fuel mixture is used, problems occur in that it is difficult to obtain good combustion, in that the specific fuel consumption will deteriorate, and in that the amount of unburned hydrocarbons in the exhaust gas will be increased. Methods to eliminate such problems by increasing the ignition energy or increasing the size of the spark gap of the spark plugs are known. However, while the use of such methods improves the ignition, it makes it impossible to increase the burning velocity of a lean air-fuel mixture. A method to increase the burning velocity of a lean air-fuel mixture, by causing a strong turbulence of the lean air-fuel mixture is known. However, too strong a turbulence of the lean air-fuel mixture extinguishes, the flame of the lean air-fuel mixture ignited by the spark plug, thus, the turbulence of the lean air-fuel mixture cannot be made too strong.

An engine capable of increasing the burning velocity of an air-fuel mixture is disclosed in Japanese Utility Model Laid-Open Publication 49-42322. In this engine, a plurality of spaced electrode pieces is arranged aligned with each other in series for forming spark gaps between adjacent electrode pieces. A high voltage is applied across the electrode pieces so that a discharge arc is created in the plurality of spark gaps formed between adjacent electrode pieces arranged in series. In this engine, even if the propagating speed is the same as that in a conventional engine, since the combustion is started from a plurality of points in the combustion chamber at the same time, the length of time during which the combustion is carried out is shortened. This makes it possible to increase the burning velocity of an air-fuel mixture. However, since this engine is constructed with each of the electrode pieces merely formed by a bar member and with a discharge arc created in a plurality of the spark gaps arranged in series, a problem occurs in that increased voltage is necessary across the electrode pieces for creating a discharge arc.

SUMMARY OF THE INVENTION

An object of the present invention is to provide an internal combustion engine capable of creating a discharge arc in a plurality of spark gaps arranged in series by applying an extremely low voltage across the electrode pieces.

According to the present invention, there is provided an internal combustion engine comprising: a cylinder block having a cylinder bore therein; a piston reciprocally movable in said cylinder bore; a cylinder head fixed onto said cylinder block and having an interior combustion space therein; a voltage source for generating a high voltage; a metallic plate inserted between said cylinder block and said cylinder head and electrically connected to said cylinder block, said metallic plate having an opening which interconnects said cylinder bore to said interior combustion space and has an inner peripheral wall exposed to said cylinder bore and said interior combustion chamber, said metallic plate having a plurality of bores formed on the inner peripheral wall of said opening and arranged in series; a first electrode arranged on the inner peripheral wall of said opening and electrically connected to said cylinder block; a second electrode arranged on the inner peripheral wall of said opening and electrically connected to said voltage source; a plurality of third electrodes arranged in series on the inner peripheral wall of said opening between said first electrode and said second electrode, each of said third electrodes having an electrode piece which has opposite ends each being spaced from the adjacent electrode by a predetermined distance for forming a spark gap therebetween, each of said third electrodes having a conductive bar member connected to said electrode piece and extending through the corresponding bore of said metallic plate; and a plurality of tubular insulating members each surrounding said conductive bar member and inserted into the bores of said metallic plate for forming a condensor between said conductive bar member and said metallic plate.

The present invention may be more fully understood from the description of preferred embodiments of the invention set forth below, together with the accompanying drawings.

DESCRIPTION OF PREFERRED EMBODIMENTS

Figure 1:
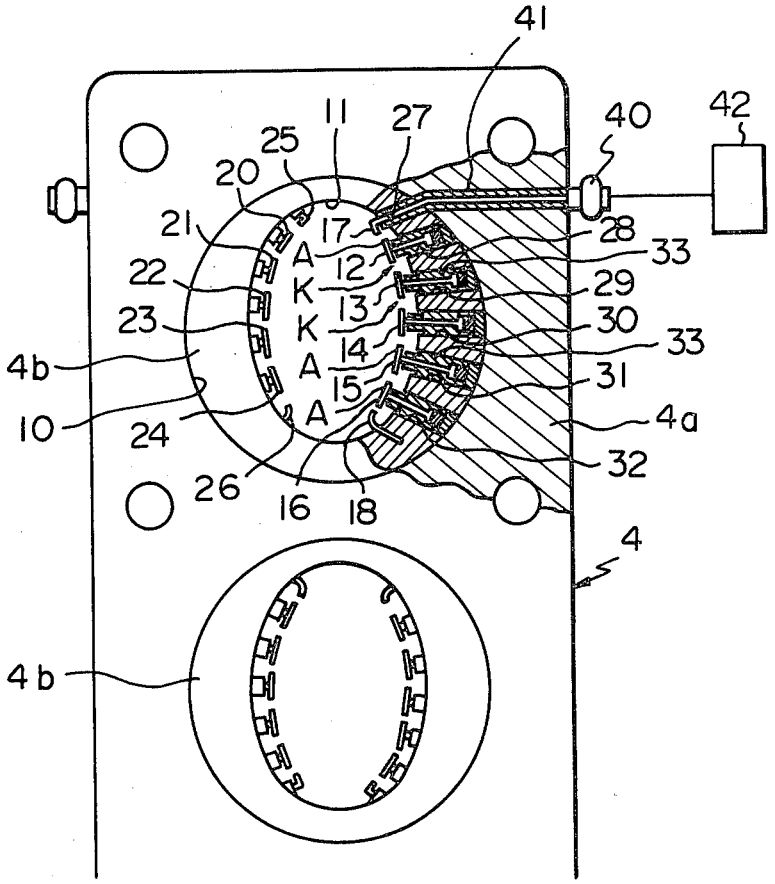
FIG. 1 is a plan view, partly in cross-section, of an embodiment of a spacer according to the present invention.
Figure 3:
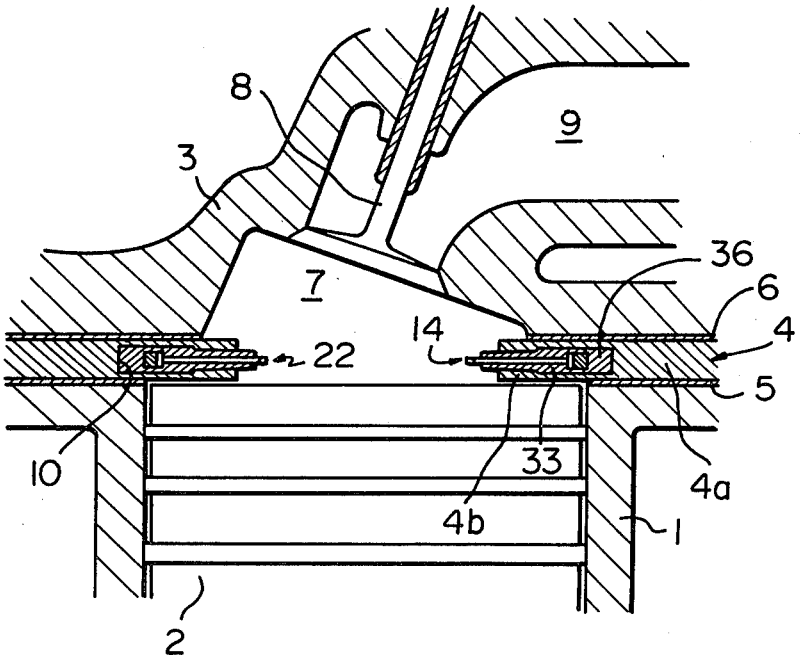
FIG. 3 is a cross-sectional side view of an internal combustion engine equipped with the spacer illustrated in FIG. 1.

Referring to FIGS. 1 and 3, reference numeral 1 designates a cylinder block, 2 a piston reciprocally movable in the cylinder block 1, 3 a cylinder head fixed onto the cylinder block 1 via a flat plate-shaped spacer 4, and 5 a gasket inserted between the cylinder block 1 and the spacer 4; 6 designates a gasket inserted between the cylinder head 3 and the spacer 4, 7 a wedge-shaped combustion chamber formed between the cylinder head 3 and the piston 2, 8 an intake valve, and 9 an intake port. As illustrated in FIGS. 1 and 3, the spacer 4 comprises an insulating plate **4*a*, made of a synthetic resin, and a plurality of disc-shaped plates 4*b*** made of a metallic material. The insulating plate 4*a* has a plurality of circular holes 10, each of which is provided for the corresponding cylinder. The metallic plates 4*b* are fitted into the corresponding circular holes 10. As will be understood from FIG. 3, the metallic plates 4*b* have a thickness which is almost the same as that of the insulating plate 4*a*, and the metallic plates 4*b* have an outer diameter which is larger than that of the piston 2. In addition, each of the metallic plates 4*b* is electrically grounded to the cylinder head 3 and the cylinder block 1 via metallic frames (not shown) each covering the peripheral edges of the gaskets 5 and 6. As illustrated in FIG. 1, each of the metallic plates 4*b* has a pseudoellipse-shaped opening 11 at the central portion thereof. A plurality of T-shaped electrodes 12, 13, 14, 15, 16 and a pair of L-shaped electrodes 17, 18 are arranged on the inner peripheral wall of the opening 11 in such a way that each of the electrodes 12, 13, 14, 15, 16, 17, 18 is spaced from the adjacent electrode by a predetermined distance. The electrodes 12, 13, 14, 15, 16, 17, 18 comprise a first electrode group. On the other hand, a plurality of T-shaped electrodes 20, 21, 22, 23, 24 and a pair of L-shaped electrodes 25, 26 are arranged on the inner peripheral wall of the opening 11, which is located opposite to the first electrode group, in such a way that each of the electrodes 20, 21, 22, 23, 24, 25, 26 is spaced from the adjacent electrode by a predetermined distance. The electrodes 20, 21, 22, 23, 24, 25, 26 comprise a second electrode group. As mentioned above, the first electrode group and the second electrode group are provided for each metallic plate 4*b*. The second electrode group has an arrangement and a construction similar to those of the first electrode group. Therefore, the arrangement and the construction of only the first electrode will be hereinafter described.

Figure 2:
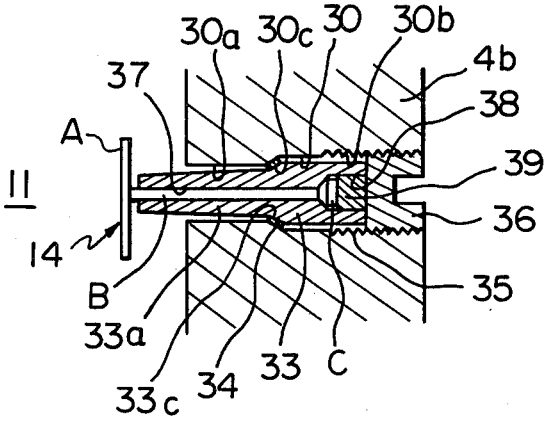
FIG. 2 is an enlarged cross-sectional plan view of a portion of the spacer illustrated in FIG. 1.

Referring to FIGS. 1 through 3, a plurality of bores 28, 29, 30, 31, 32, each extending from the opening 11 toward the outer peripheral wall of the metallic plate 4*b*, is formed in the metallic plate 4*b*. Tubular insulating members 33, each supporting the corresponding T-shaped electrode 12, 13, 14, 15, 16, are inserted into the bores 28, 29, 30, 31, 32. The tubular insulating members 33 have a similar construction, and the T-shaped electrodes 12, 13, 14, 15, 16 have a similar construction. Consequently, the construction of only the T-shaped electrode 14 will be hereinafter described, with reference to FIG. 2. Referring to FIG. 2, the bore 30 comprises a reduced diameter portion 30*a* which is open to the opening 11, an increased diameter portion 30*b* which is open to the exterior of the metallic plate 4*b* on the outer peripheral wall of the metallic plate 4*b*, and a frustum-shaped step portion 30*c* formed between the reduced diameter portion 30*a* and the increased diameter portion 30*b*. On the other hand, the tubular insulating member 33 comprises a reduced diameter portion 33*a* extending through the reduced diameter portion 30*a* of the bore 30, an increased diameter portion 33*b* extending through the increased diameter portion 30*b* of the bore 30, and a frustum-shaped step portion 33*c* formed between the reduced diameter portion 33*a* and the increased diameter portion 33*b*. An annular gasket 34 is inserted between the step portion 30*c* of the bore 30 and the step portion 33*c* of the tubular insulating member 33. The reduced diameter portion 33*a* of the tubular insulating member 33 projects into the opening 11, and the increased diameter portion 33*b* of the tubular insulating member 33 is retracted into the increased diameter portion 30*b* of the bore 30. An internal screw thread 35 is formed on the inner wall of the increased diameter portion 30*b* of the bore 30. A screw 36 is screwed onto the internal screw thread 35. On the other hand, the T-shaped electrode 14 comprises an electrode piece A, a conductive bar member B extending from the central portion of the electrode piece A at a right angle relative to the electrode piece A, and an enlarged portion C formed in one piece on the free end of the conductive bar member B. The tubular insulating member 33 has an axially extending central bore 37, and the conductive bar member B extends through the central bore 37. In addition, the central bore 37 has an enlarged portion 38 at the outermost end thereof, and the enlarged portion C of the T-shaped electrode 14 is located in the deep interior of the enlarged portion 38. The enlarged portion 38 is filled with an electrically insulating material 39 such as glass.

The tubular insulating member 33 is made of a ceramic material. The conductive bar member B and the enlarged portion C of the T-shaped electrode 14 are embedded into the tubular insulating member 33 when the tubular insulating member 33 is formed. The enlarged portion 38 of the central bore 37 is formed at this time. Then, the enlarged portion 38 is filled with glass powder, and the tubular insulating member 33 is heated until the glass powder melts. After this, the tubular insulating member 33 is cooled and, as a result, the enlarged portion 38 is filled with the glass 39, as illustrated in FIG. 2. The tubular insulating member 33 is inserted into the bore 30, and the screw 36 is screwed into the increased diameter portion 30*b* of the bore 30. As a result of this, the tubular insulating member 33 is fixed onto the metallic plate 4*b*. Since the gasket 34 is inserted between the step portion 33*c* of the tubular insulating member 33 and the step portion 30*c* of the bore 30, it is possible to prevent burned gas from escaping via the bore 30.

As illustrated in FIG. 1, the electrode pieces A of the T-shaped electrodes 12, 13, 14, 15, 16 are arranged in series along the inner peripheral wall of the opening 11 in such a way that each of the electrode pieces A is spaced from the adjacent electrode piece A. Consequently, a spark gap K is formed between the adjacent electrode pieces A. The L-shaped electrode 17, which is arranged adjacent to the electrode piece A of the T-shaped electrode 12, extends through the metallic plate 14*b* and then through the insulating plate 4*a* and is connected to a terminal 40 fixed onto the outer wall of the insulating plate 4*a*. The L-shaped electrode 17, except for its tip portion projecting into the opening 11, is surrounded by an insulating member 41, and the terminal 40 is connected to a high voltage source 42. On the other hand, the L-shaped electrode 18, which is arranged adjacent to the electrode piece A of the T-shaped electrode 16, is fixed onto the metallic plate 4*b* and, therefore, the L-shaped electrode 18 is grounded to the cylinder head 3 and the cylinder block 1 via the metallic plate 4*b*. When a high voltage is applied to the terminal 40, a discharge arc generates in each spark gap K.

Figure 4:
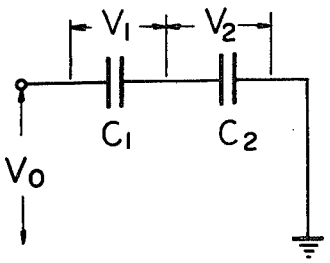
FIG. 4 is an illustrative view for illustrating a conventional ignition system.

The spark gap K can be considered as a condensor and, therefore, in the case wherein the spark gaps K are arranged in series as in a conventional ignition system, the spark gaps K are represented as illustrated in FIG. 4. In FIG. 4, when a high volta $V_0$ is applied across a pair of the spark gaps K, that is, a pair of the condensors $C_1$ and $C_2$, the voltage $V_1$ and $V_2$, appearing across the condensors $C_1$ and $C_2$, respectively, are indicated by the following equations.

$$V_1 = \frac{C_2}{C_1 + C_2} V_0$$

$$V_2 = \frac{C_1}{C_1 + C_2} V_0$$

Assuming that the capacitance of $C_1$ is equal to that of $C_2$, the above equations can be rewritten as follows:

$$V_1 = V_0/2$$

$$V_2 = V_0/2$$

Assuming that a discharge arc generates in the spark gaps K when $V_1$ and $V_2$ becomes equal to $V_S$, the voltage $V_0$ is represented as follows.

$$V_0 = 2V_S$$

Consequently, in a conventional ignition system, in order to produce a discharge arc in the spark gaps K, it is necessary to apply the voltage $V_0$, which is twice the discharge voltage $V_S$, across the spark gaps K.

Figure 5:
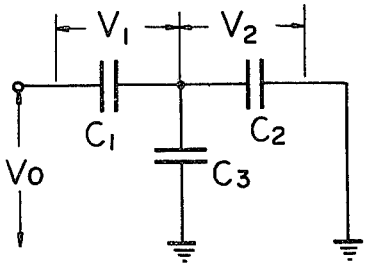
FIG. 5 is an illustrative view for illustrating an ignition system according to the present invention.

Contrary to this, in the present invention, as illustrated in FIG. 3, the conductive bar member B and the enlarged portion C are surrounded by the tubular insulating member 33, and the tubular insulating member 33 is surrounded by the metallic plate 4*b*. Consequently, a condensor is formed between the conductive bar member B and the metallic plate 4*b*. If this condensor is indicated by $C_3$, and only two spark gaps K are present, the spark gaps K and the condensor $C_3$ are represented as illustrated in FIG. 5. In FIG. 5, when a high voltage $V_0$ is applied across a pair of the spark gaps K, that is, a pair of the condensors $C_1$ and $C_2$, the voltage $V_1$ and $V_2$, appearing across the condensors $C_1$ and $C_2$, respectively, are indicated by the following equations:

$$V_1 = \frac{C_2 + C_1}{C_1 + C_2 + C_3} V_0$$

$$V_2 = \frac{C_1}{C_1 + C_2 + C_3} V_0$$

Assuming that the capacitance of $C_1$ is equal to that of $C_2$, and that the capacitance of $C_3$ is approximately 10 times the capacitance of $C_1$, $C_2$, the above equations can be rewritten as follows:

$$V_1 = \frac{11}{12} V_0$$

$$V_2 = \frac{1}{12} V_0$$

Assuming that the voltage necessary to produce a discharge arc in the spark gaps K is indicated by $V_S$, the voltage $V_0$ necessary to produce a discharge arc in the spark gap K illustrated by the condensor $C_1$ is represented as follows:

$$V_0 = \frac{12}{11} V_S$$

In addition, the voltage $V_0$ necessary to produce a discharge arc in the spark gap K illustrated by the condensor $C_2$ is represented as follows:

$$V_0 = 12V_S$$

Consequently, when the voltage $V_0$ becomes slightly larger than the discharge voltage $V_S$, a discharge arc generates in the spark gap K illustrated by the condensor $C_1$ and, at this time, the spark gap K illustrated by the condensor $C_2$ is maintained in a insulating state.

Figure 6:
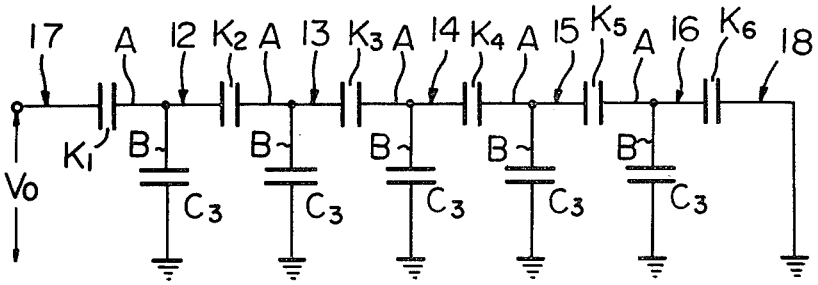
FIG. 6 is a schematic view of an ignition system according to the present invention.

FIG. 6 schematically illustrates the first electrode group illustrated in FIG. 1. In FIG. 6, when a high voltage $V_0$ which is slightly larger than the discharge voltage $V_S$ is applied to the L-shaped electrode 17, a discharge arc generates in the discharge gap $K_1$. If the discharge arc generates in the spark gap $K_1$, since the spark gap $K_1$ is turned to a conductive state, electric current flows into the condensor $C_3$ having a large capacity and, as a result, the voltage of the electrode piece A of the T-shaped electrode 12 is increased to $V_0$. If the voltage of the electrode piece A of the T-shaped electrode 12 is increased to $V_0$, as mentioned above, a discharge arc generates in the discharge gap $K_2$. Consequently, it will be understood that if the high voltage $V_0$, which is slightly larger than the discharge voltage $V_S$, is applied to the L-shaped electrode 17, a discharge arc successively generates in the spark gaps $K_1$, $K_2$, $K_3$, $K_4$, $K_5$, and $K_6$. In order to produce the discharge arc in the spark gaps $K_1$, $K_2$, $K_3$, $K_4$, $K_5$, $K_6$ by applying the high voltage $V_0$ which is slightly larger than the discharge voltage $V_S$ as mentioned above, it is necessary to construct the tubular insulating member 33 so that the condensor $C_3$ has a capacitance which is more than about 10 times the capacitances of the spark gaps $K_1$, $K_2$, $K_3$, $K_4$, $K_5$, $K_6$. The capacitance of the condensor $C_3$ is inversely proportional to the thickness of the tubular insulating member 33 and is proportional to the length of the conductive bar member B located within the metallic plate 4*b*. Therefore, in order to produce the discharge arc in the spark gaps $K_1$, $K_2$, $K_3$, $K_4$, $K_5$, $K_6$ by applying the high voltage $V_0$ which is slightly larger than the discharge voltage $V_S$, it is necessary to construct the tubular insulating member 33 and the T-shaped electrodes 12, 13, 14, 15, 16 so that the thickness of the tubular insulating member 33 is less than 2 mm and so that the length of the conductive bar member B located within the metallic plate 4*b* is more than 10 mm. In addition, in order to prevent a discharge arc from generating in the condensor $C_3$, it is necessary to form the tubular insulating member 33 by a material having a large dielectric constant. Furthermore, in order to reduce the consumption of the electrodes 12, 13, 14, 15, 16, 17, 18, it is preferable that platinum chips be attached to the tips of the electrodes 12, 13, 14, 15, 16, 17, 18.

Figure 7:
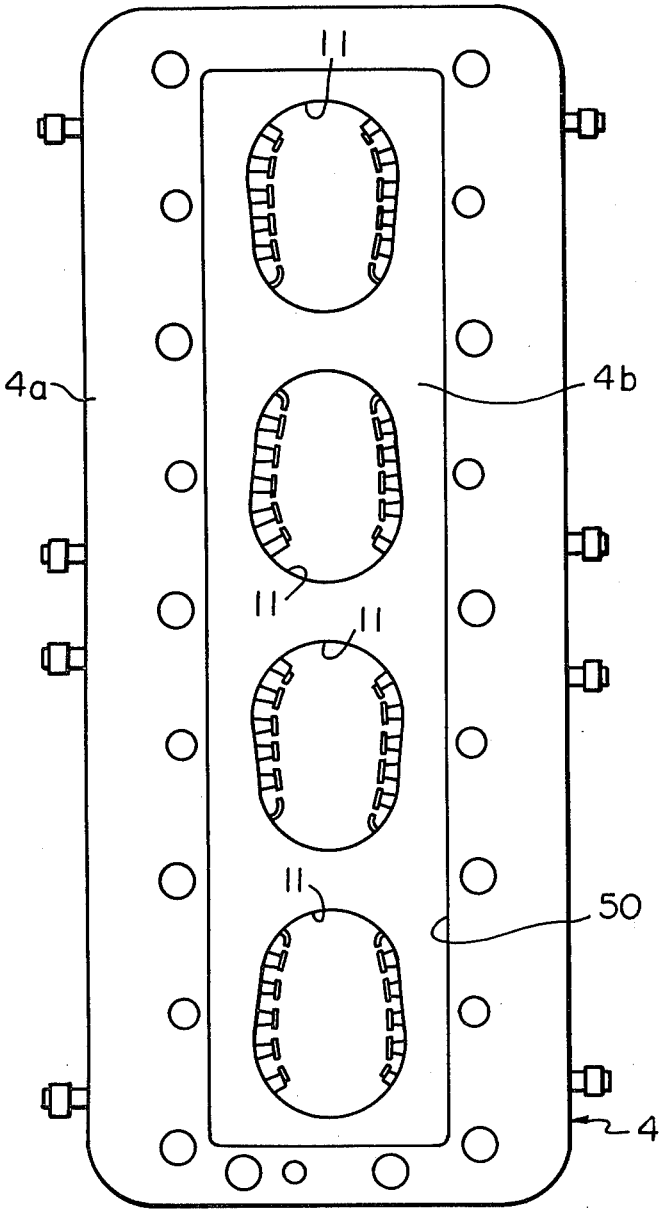
FIG. 7 is a plan view of an alternative embodiment of a spacer according to the present invention.

FIG. 7 illustrates an alternative embodiment. In this embodiment, the plate 4 has a single rectangular hole 50, and a single metallic plate 4*b* is fitted into the hole 50. A plurality of openings 11 is formed on the metallic plate 4*b*, and the first electrode group and the second electrode group are provided for each opening 11. In addition, instead of forming the plate 4 by separate two plates as illustrated in FIG. 7, the entire plate 4 may be formed by a metallic material.

According to the present invention, it is possible to produce a discharge arc in a plurality of the spark gaps arranged in series by applying a high voltage across the spark gaps, which voltage is slightly higher than the voltage necessary to produce a discharge arc in a single discharge gap. In addition, since a high voltage, necessary to produce a discharge arc in the spark gaps, is not increased even if the number of the spark gaps is increased, there is an advantage that it is possible to increase the number of the spark gaps as compared with a conventional ignition system. Furthermore, since the condensor is formed between the conductive bar member of the T-shaped electrode and the metallic plate surrounding the conductive bar member, there is another advantage that it is possible to easily increase the capacitance of the condensor.

While the invention has been described by reference to specific embodiments chosen for purposes of illustration, it should be apparent that numerous modifications could be made thereto by those skilled in the art without departing from the basic concept and scope of the invention.

We claim:

1. An internal combustion engine comprising:
a cylinder block having a cylinder bore therein;
a piston reciprocally movable in said cylinder bore;
a cylinder head fixed onto said cylinder block and having an interior combustion space therein;
a voltage source for generating a high voltage;
a metallic plate inserted between said cylinder block and said cylinder head and electrically connected to said cylinder block, said metallic plate having an opening which interconnects said cylinder bore to said interior combustion space and has an inner peripheral wall exposed to said cylinder bore and said interior combustion chamber, said metallic plate having a plurality of bores formed on the inner peripheral wall of said opening and arranged in series;
a first electrode arranged on the inner peripheral wall of said opening and electrically connected to said cylinder block;
a second electrode arranged on the inner peripheral wall of said opening and electrically connected to said voltage source;
a plurality of third electrodes arranged in series on the inner peripheral wall of said opening between said first electrode and said second electrode, each of said third electrodes having an electrode piece which has opposite ends each being spaced from the adjacent electrode by a predetermined distance for forming a spark gap therebetween, each of said third electrodes having a conductive bar member connected to said electrode piece and extending through the corresponding bore of said metallic plate; and
a plurality of tubular insulating members each surrounding said conductive bar member and inserted into the bore of said metallic plate for forming a condensor between said conductive bar member and said metallic plate.

2. An internal combustion engine according to claim 1, wherein said first electrode has an L-shape and is directly fixed onto said metallic plate.

3. An internal combustion engine according to claim 1, wherein said second electrode has an L-shape and has a portion extending through the corresponding bore of said metallic plate and surrounded by an insulating material.

4. An internal combustion engine according to claim 1, wherein each of said third electrodes has a T-shape.

5. An internal combustion engine according to claim 1, wherein said conductive bar member has an enlarged portion on its end located opposite to said electrode piece.

6. An internal combustion engine according to claim 5, wherein said tubular insulating member has a central bore through which said conductive bar member extends, said central portion having an enlarged portion within which the enlarged portion of said conductive bar member is located, the enlarged portion of said central bore being filled with an insulating material for covering the enlarged portion of said conductive bar member by said insulating material.

7. An internal combustion engine according to claim 1, wherein said tubular insulating member has a thickness which is less than 2 mm, the length of said tubular insulating member located with said metallic plate being more than 10 mm.

8. An internal combustion engine according to claim 1, wherein each of the bores of said metallic plate comprises a reduced diameter portion, an increased diameter portion, and a frustum-shaped step portion formed between said reduced diameter portion and said increased diameter portion, each of said tubular insulating members comprising a reduced diameter portion which extends through the reduced diameter portion of said bore, an increased diameter portion which extends through the increased diameter portion of said bore, and a frustum-shaped step portion formed between the reduced diameter portion and the increased diameter portion of said tubular insulating member, a gasket being inserted between the step portion of said bore and the step portion of said tubular insulating member.

9. An internal combustion engine according to claim 8, wherein an inner screw thread is formed on the inner wall of the increased diameter portion of said bore and a screw is screwed into the increased diameter portion of said bore for fixing said tubular insulating member onto said metallic plate.

10. An internal combustion engine according to claim 1, wherein each of said electrodes has a tip to which a platinum chip is attached.

11. An internal combustion engine according to claim 1, wherein said opening has a cross-sectional area which is smaller than that of said cylinder bore.

12. An internal combustion engine according to claim 11, wherein the entire inner peripheral wall of said opening projects from inner walls of said cylinder bore and said interior combustion space.

13. An internal combustion engine according to claim 1, wherein a spacer, made of an insulating material and having a hole therein, is inserted between said cylinder block and said cylinder head, said metallic plate being fitted into said hole.

* * * * *